US005133410A

United States Patent [19]

Gadelle et al.

[11] Patent Number: 5,133,410

[45] Date of Patent: Jul. 28, 1992

[54] METHOD AND DEVICE FOR STIMULATING PRODUCTION OF A SUBTERRANEAN ZONE OF INJECTION OF A FLUID FROM A NEIGHBORING ZONE VIA FRACTURE MADE FROM A DEFLECTED DRAIN DRILLED IN AN INTERMEDIATE LAYER SEPARATING THE ZONES

[75] Inventors: Claude Gadelle, Reuil-Malmaison; Jacques Lessi, Maule; Gérard Renard, Rueil-Malmaison, all of France

[73] Assignee: Institut Francais Du Petrole, Rueil-Malmaison, France

[21] Appl. No.: 636,294

[22] Filed: Dec. 31, 1990

[30] Foreign Application Priority Data

Dec. 29, 1989 [FR] France ..... 89 17482

[51] Int. Cl.[5] ..... E21B 43/26

[52] U.S. Cl. ..... 166/308; 166/50; 166/52; 166/370

[58] Field of Search ..... 166/245, 306, 308, 50, 166/52, 191, 233, 236, 369, 370; 175/61, 62

[56] References Cited

U.S. PATENT DOCUMENTS

| | | | |
|---|---|---|---|
| 2,736,381 | 2/1956 | Allen | 166/306 X |
| 3,020,954 | 2/1962 | Graham et al. | 166/308 X |
| 3,354,952 | 11/1967 | Engle | 166/306 X |
| 4,248,302 | 2/1981 | Churchman | 166/50 X |
| 4,474,409 | 10/1984 | Trevits et al. | 166/308 X |
| 4,519,463 | 5/1985 | Schub | 166/50 X |
| 4,679,630 | 7/1987 | Wyman | 166/308 X |
| 4,714,117 | 12/1987 | Dech | 166/50 X |
| 4,945,994 | 8/1990 | Stagg | 166/50 X |
| 5,016,710 | 5/1991 | Renard et al. | 166/50 X |

*Primary Examiner*—George A. Suchfield

*Attorney, Agent, or Firm*—Antonelli, Terry, Stout & Kraus

[57] ABSTRACT

A subterranean zone and a neighboring zone are, respectively, a petroliferous deposit and an underlying aquiferous nappe at a pressure higher than that prevailing in the subterranean zone, the two zones being separated by an intermediate substantially impervious or slightly permeable layer. A method of stimulating production of effluent from the subterranean zone includes drilling at least one deflected well, preferably nearly or totally horizontal in the intermediate layer and in connecting the two zones together through fractures of the intermediate layer made from the drain. The drain can be equipped with a pipe fitted with openings on a part of its length, with packers or like devices for effecting total or partial confining of the drain and with a fluid pressure source for causing fractures in the intermediate layer at the level of the confined portion. Through the fractures made during the production, water under pressure from the neighboring zone can be injected into the petroliferous zone which stimulates drainage of the deposit.

10 Claims, 3 Drawing Sheets

METHOD AND DEVICE FOR STIMULATING PRODUCTION OF A SUBTERRANEAN ZONE OF INJECTION OF A FLUID FROM A NEIGHBORING ZONE VIA FRACTURE MADE FROM A DEFLECTED DRAIN DRILLED IN AN INTERMEDIATE LAYER SEPARATING THE ZONES

BACKGROUND OF THE INVENTION

The present invention relates to a method for stimulating a subterranean zone through the deferred injection of fluid under pressure coming from a neighbouring zone by means of a deflected drain running through a slightly permeable intermediate layer. What is called a deflected drain hereinafter is any wellbore at least part of which is horizontal or relatively slightly inclined in relation to the horizontal.

The method according to the invention more particularly stimulates the production of a petroliferous zone separated from an underlying zone containing a fluid under pressure, such as an aquiferous zone or possibly a petroliferous zone.

Various techniques known by specialists are utilized for stimulating the production of petroliferous zones. One of them essentially consists in injecting a fluid under pressure into the formation in production, capable of draining the oil stagnating in the rocks because of its viscosity. The fluid used is, for example, water under pressure injected by drains bored through the formation. It can also be water existing in depth, in the basin in production itself, in the form of an underlying aquiferous nappe.

In certain types of basins, the aquiferous nappe lies under the petroliferous zone and is separated from the zone by a layer which is slightly permeable notably because of the presence of heavy and very viscous hydrocarbon products (tarmat).

It can be envisaged to utilize this underlying water to stimulate the production of a petroliferous zone. The water nappe being located at a depth greater than that of the petroliferous zone, its inner pressure is higher. The at least partial depletion of the zone in production has the effect of increasing the overpressure of the water in the underlying nappe in relation to the fluids in the zone above. The possible injection into the petroliferous formation of this overpressure water should act to drain the oil and to stimulate production.

The attempts to stimulate production zones topping aquiferous nappes have not yet produced the expected results. Vertical wells or drains have been bored through the petroliferous zone in order to make the petroliferous deposit communicate with the water nappe. But it has been noticed that this type of well essentially produces water. This negative result can be explained by the fact that the water in the nappe tends to directly escape towards the surface through the well that has been created, instead of entering the petroliferous formation. This phenomenon persists if an obturation device is taken down into the well, because the water of the nappe tends to flow round it through the surrounding formations. A possible obturation near the surface causes a certain diffusion of the water in the petroliferous zone. But the results are not very significant because the volume of the deposit penetrated by the water remains relatively low.

SUMMARY OF THE INVENTION

The method according to the invention allows to stimulate the production of a subterranean zone through the deferred injection of a fluid coming from a neighbouring zone separated from the first one by a slightly permeable intermediate layer, by avoiding the drawbacks mentioned above.

It is characterized by the drilling of at least one deflected drain in said intermediate layer and by the subsequent opening, by fracturing the intermediate layer, of at least one communication channel linking the neighbouring zone to the subterranean zone, in order to promote the draining of said subterranean zone by the fluid under pressure.

The method of the invention creates, from the deflected drain, fractures in the intermediate layer thereby making a petroliferous zone communicate with an underlying aquiferous zone.

The method also creates, from the deflected drain, fractures in the intermediate layer thereby making a petroliferous zone communicate with an underlying second petroliferous zone.

The deflected drain can be drilled in a slightly permeable intermediate layer. It can also be drilled in a non-petroliferous intermediate layer.

The device according to the invention is characterized by a pipe arranged in a deflected drain drilled in the intermediate layer, said pipe being fitted with openings on a part of its length, packer means for isolating the portions of the pipe on the part of the latter fitted with openings, and means for applying hydraulic pressures capable of fracturing the intermediate layer and of making the two zones on either side of said intermediate layer to communicate with each other during the period of production.

Injecting a fluid under pressure into a subterranean zone such as an oil deposit whose inner pressure is lowered because of the production, through the fracturing of an intermediate layer from a drain drilled along the latter and properly confined in order to prevent the fluid from escaping towards the surface, has the effect of pushing the oil towards the production wells. The use of a deflected drain (horizontal or slightly inclined towards the horizontal) increases the volume of the zone invaded by the injected fluid. When the neighbouring zone is an active aquiferous zone, i.e. permanently resupplied by water influxes, the injection pressure undergoes no substantial drop throughout the draining phase. The desired effect lasts longer.

BRIEF DESCRIPTION OF THE DRAWINGS

Other features and advantages of the method according to the invention will be clear from reading the description hereafter of an embodiment procedure given by way of non-limitative examples, with reference to the accompanying drawings in which.

DESCRIPTION OF THE PREFERRED EMBODIMENTS

Figure 1:
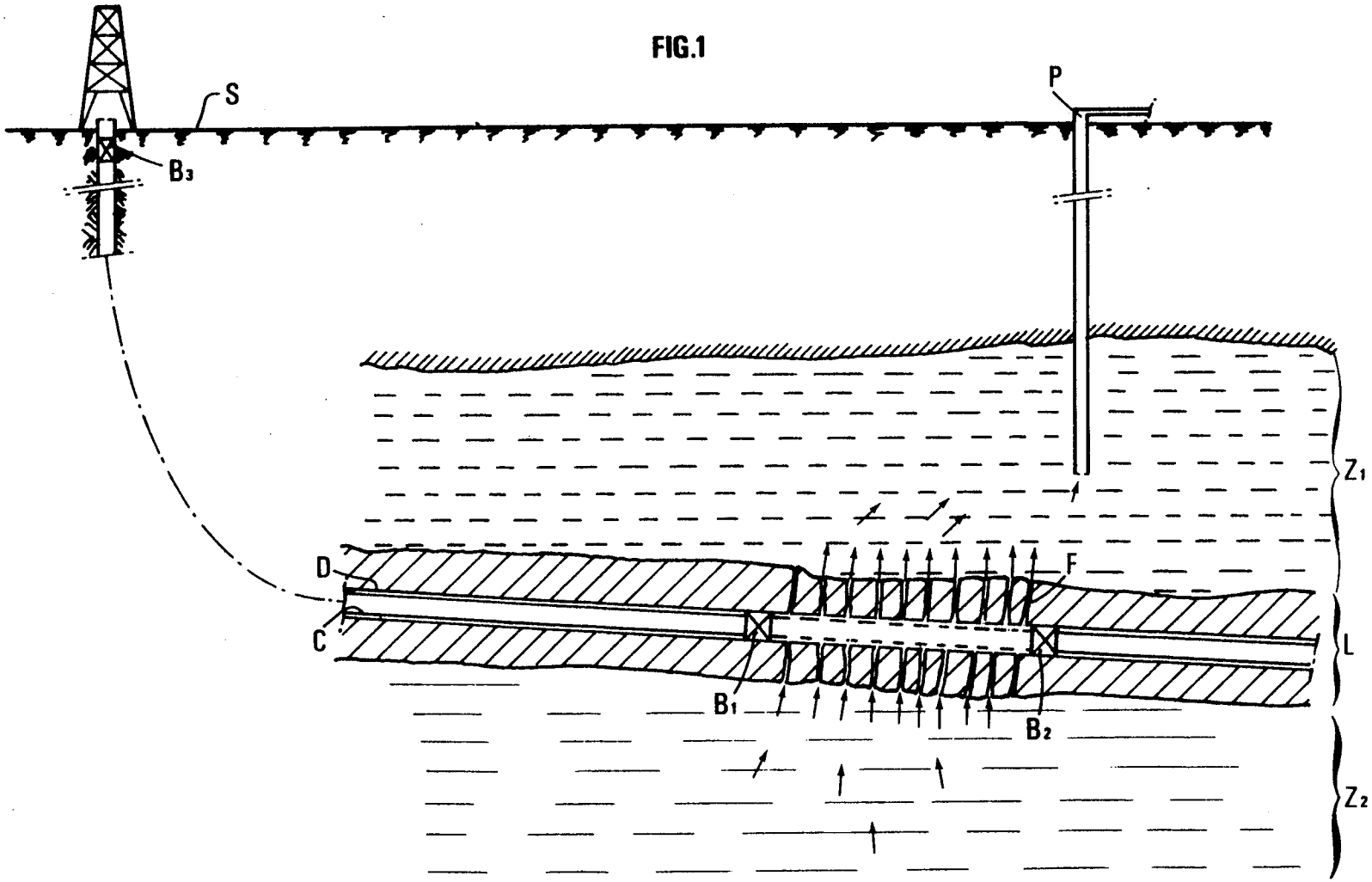
FIG. 1 diagrammatically shows a section of a petroliferous production zone topping a zone containing a fluid under pressure, such as an aquiferous zone, and a first embodiment of the method according to the invention.
Figure 3:
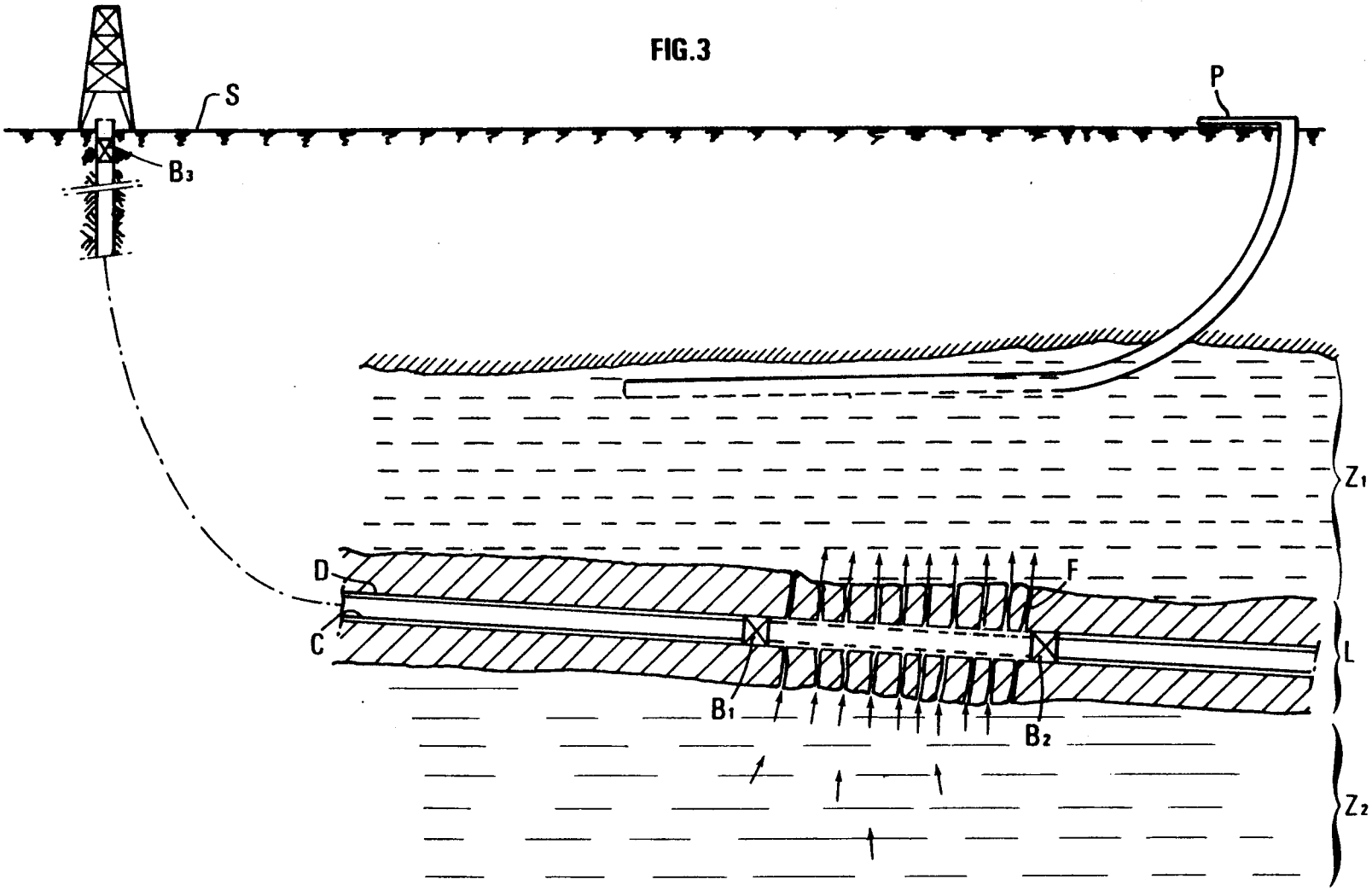
FIG. 3 diagrammatically shows a section of two superimposed zones arranged similar to FIG. 1 wherein a deflecting well is used as a production well.

The petroliferous zone Z1 produces oil through at least one production well P. This well may be vertical as shown on FIG. 1 or, according to FIG. 3, horizontal. In certain types of basins, a neighbouring zone containing a fluid under pressure lies below petroliferous zone Z1 and is separated from it by a slightly permeable layer L. The pressure of this fluid is higher than the pressure prevailing in production zone Z1 because the neighbouring zone lies deeper. This fluid may be water or an oil-bearing fluid. When the neighbouring zone is aquiferous, it is generally of the active type, i.e. it is supplied by external water influxes and the pressure which prevails within remains substantially constant. The intermediate layer L can be for example a zone made substantially impermeable because of the presence of very heavy and viscous hydrocarbon products. This layer L can also be of a non petroliferous type.

The method according to the invention comprises the drilling from the surface S of a deflected drain D (horizontal or slightly inclined in relation to the horizontal) in order to remain within the intermediate layer. When drain D is drilled, it is fitted with a casing C on its total length. Obturation or closure means of a well-known type allow to close the annular space between the casing and the drain. On at least one portion d1 of its length, where it runs through the production zone, casing C is fitted with lateral openings connecting the formations crossed together with the inside of drain D. At this stage, there is no communication between the two zones Z1 and Z2. The drain can be drilled at any moment, before the bringing in of the petroliferous zone Z1 or possibly during the period of production.

During this period, when it appears that zone Z1 requires a stimulation, fracturing operations of the intermediate layer are performed from drain D which has been previously drilled. To that effect, and by means of a method known by specialists, expansible obturation or closure devices B1, B2 are taken down into casing C right to the part fitted with lateral openings and they are arranged in order to confine a limited portion of the casing. Through a pipe (not shown) connecting the confined part together with a hydraulic system, a fluid is applied with a pressure sufficient for fracturing the walls until communication channels F are achieved between the two zones Z1 and Z2. The previous sequence of operations is possibly repeated in several different locations of the drain, in order to enlarge the fractured zone.

When the fracturing operations are over, a packer means B3 is installed in the casing in order to isolate the drain from the external medium. The fluid, in this case the water of zone Z2, being at a higher pressure and the drain being confined by the packer means B3, the water enters zone Z1 through the channels F of casing C and drives away the hydrocarbons accumulated in the formation.

Figure 2:
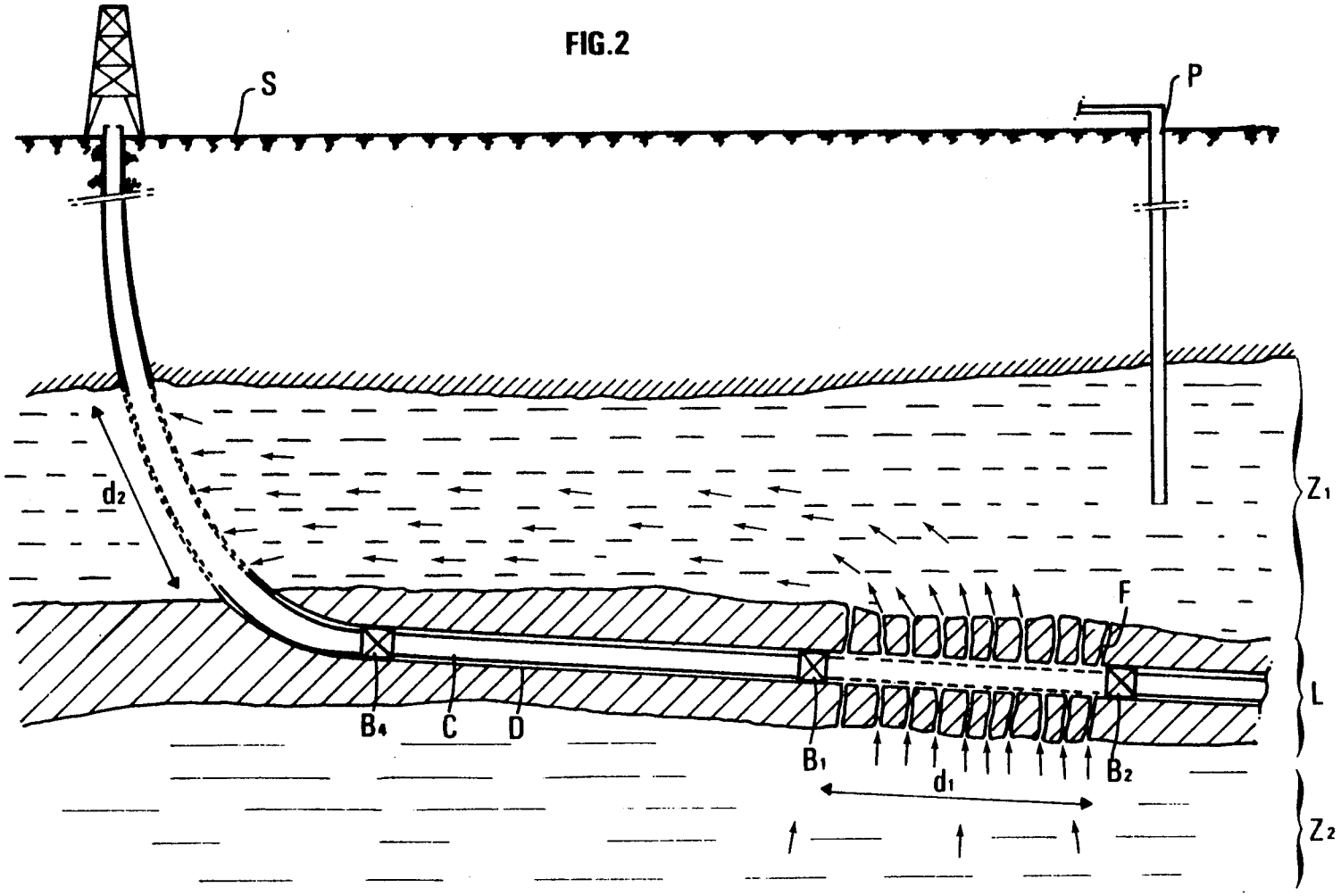
FIG. 2 diagrammatically shows a similar section as in FIG. 1 with a second embodiment of the method.

According to the embodiment procedure of FIG. 2, drain D is arranged in order to be able to be used as a production well. To that effect, casing C is fitted in its part which crosses production zone Z1, with another portion of length d2 fitted with lateral openings. According to the case, this other casing portion d2 is more or less distant from portion d1 which the water coming from zone Z2 can come through, and laterally shifted in relation to the latter. A closure device B4, the closing of which can be released from the surface installation, is arranged between the two portions d1 and d2.

During the period of production, when a stimulation of the production is necessary, a fracturing of the portion of length d1 of the casing is performed, in the same way as in the previous embodiment, and device B4 is closed in order to isolate the two parts d1 and d2 of the casing from one another. The water coming from the underlying zone enters the production zone Z1 through the channels F and drives the oil away towards the production wells and notably towards part d2 of casing C that is open on the external medium. The drain thereby takes part in the production.

The method according to the invention therefore allows to utilize at best the fluid under high pressure which is available in situ in order to stimulate the oil production.

The position of the vertical and/or horizontal production wells in relation to the deflected drains D or conversely, of the drains in relation to the wells, according to the order following which they have been drilled, is selected according to known procedures in order to optimize the oil production.

We claim:

1. A method for stimulating the production of an effluent out of a subterranean zone through the controlled injection of a fluid under pressure from a neighbouring zone separated from said subterranean zone by an impervious or slightly permeable intermediate layer, comprising:

drilling a deflected drain in said intermediate layer; and when stimulation of said subterranean zone is necessary, fracturing said intermediate layer to provide at least one communication channel extending from said neighbouring zone to said subterranean zone, thereby stimulating draining of said subterranean zone by the injection of the fluid under pressure.

2. A method as claimed in claim 1, wherein said subterranean zone communicates with the surface through at least one vertical production well, the deflected drain being positioned with respect to said production well to optimize the production of the effluent.

3. A method as claimed in claim 1, wherein the subterranean zone communicates with the surface through at least one deflected production well, said deflected drain being positioned with respect to said production well to optimize production of the effluent.

4. A method for stimulating the production of a petroliferous zone through the controlled injection of water under pressure from an underlying aquiferous zone separated from said petroliferous zone by an impervious or slightly permeable intermediate layer, comprising:

drilling a deflected drain in said intermediate layer; and when a stimulation of said petroliferous zone is necessary, fracturing said intermediate layer to provide at least one communication channel extending from said aquiferous zone to said petroliferous zone, thereby stimulating draining of said petroliferous zone by the injection of the water under pressure.

5. A method for stimulating the production of a petroliferous zone through the controlled injection of effluents under pressure from an underlying second petroliferous zone separated from said first petroliferous zone by an impervious or slightly permeable intermediate layer, comprising:

drilling a deflected well in said intermediate layer; and when stimulation of said first petroliferous zone is necessary, fracturing said intermediate layer to provide at least one communication channel extending from said second petroliferous zone to said first petroliferous zone, thereby stimulating draining of said first petroliferous zone by the injection of said effluents under pressure.

6. A method as claimed in claim 5, wherein the intermediate layer between said first and second zone which is a non-petroliferous layer.

7. A method as claimed in any one of the claims 1 to 6, further comprising closing the drain in a first part thereof through the intermediate layer and perforating a second part thereof along said subterranean zone and producing said subterranean zone through said second part.

8. A method as claimed in any one of claims 1 to 6 further comprising arranging a pipe in said deflected drain, said pipe having a portion with lateral openings positioned in said intermediate layer, confining a selected section of said portion with packer means and introducing a pressurized hydraulic fluid into said confined section to fracture the intermediate layer surrounding said section.

9. A well completion arrangement for stimulating the production of an effluent out of a subterranean zone separated from a neighbouring zone containing a fluid at a pressure higher than that of subterranean zone by an impervious or slightly permeable intermediate layer, which comprises a pipe arranged in a deflected drain drilled in the intermediate layer, said pipe comprising one portion of length provided with lateral openings, packer means for intermittently isolating sections of pipe in said one portion of length, packer means for confining the pipe and for isolating an outer part of said one portion of length and pressure means for applying a pressurized hydraulic fluid thereby fracturing the intermediate layer and providing at least one communication channel between said neighbouring zone and said subterranean zone.

10. A well completion arrangement as claimed in claim 9, wherein said pipe comprises a second portion of length provided with openings in the part thereof crossing said subterranean zone, said second portion being laterally shifted with respect to the first portion in the intermediate layer and a packer means arranged in the pipe between said first and second portions.

* * * * *